United States Patent [19]

Nelson

[11] Patent Number: 4,647,088

[45] Date of Patent: Mar. 3, 1987

[54] PILFERAGE DETERRENT DEVICE FOR LADING CARRYING VEHICLES, SUCH AS BOXCARS AND THE LIKE

[76] Inventor: Stanford C. Nelson, 8 S. Merrill Ave., Park Ridge, Ill. 60068

[21] Appl. No.: 737,916

[22] Filed: May 28, 1985

Related U.S. Application Data

[63] Continuation of Ser. No. 500,371, Jun. 2, 1983, abandoned, which is a continuation-in-part of Ser. No. 298,592, Sep. 2, 1981, abandoned.

[51] Int. Cl.[4] ..... E05G 3/10

[52] U.S. Cl. ..... 292/136; 292/104; 292/336

[58] Field of Search ..... 292/104, 108, 130–136, 292/210, 230, 236, 238, 231–235, 239, 205, 237, 336; 105/308 P, 308 R, 378

[56] References Cited

U.S. PATENT DOCUMENTS

| | | | |
|---|---|---|---|
| 217,874 | 7/1879 | Hotchkiss | 292/104 |
| 657,742 | 9/1900 | Lewis | 292/108 |
| 882,296 | 3/1908 | Carroll | 292/130 |
| 991,667 | 1/1908 | Browning | 173/157 |
| 1,177,495 | 3/1916 | Davis | 292/130 |
| 1,444,410 | 2/1923 | Witten | 70/154 |
| 1,446,078 | 2/1923 | Willis | 292/238 |
| 1,489,965 | 4/1924 | Prentice | 292/129 |
| 1,495,373 | 5/1924 | Witten | 292/108 |
| 1,720,042 | 7/1929 | Hankwitz | 292/238 X |
| 1,822,424 | 9/1931 | Scott | 292/346 X |
| 2,523,845 | 9/1950 | Rosenburrough | 292/108 |
| 2,599,511 | 6/1952 | Dean | 292/134 X |
| 2,749,164 | 6/1956 | Kitzelman | 292/DIG. 46 X |
| 3,201,830 | 8/1965 | Senter et al. | 20/27 |

FOREIGN PATENT DOCUMENTS 84087 6/1954 Norway .

*Primary Examiner*—Gary L. Smith
*Assistant Examiner*—Russell W. Illich
*Attorney, Agent, or Firm*—Hill, Van Santen, Steadman & Simpson

[57] ABSTRACT

Anti-pilferage device for box car doors of both the sliding and plug type in which the device is toward the top of the door out of reach of a person standing on the ground and only accessible to release the latch from the top, by a person standing on a loading dock. The latch cooperates with a keeper and both the keeper and latch are enclosed so access cannot be had to the latch to release the latch by a pole or elongated tool and the like.

A pivoted release member is provided for the latch which extends above the latch plates forming a housing for the latch toward the rear ends of said latch plates and is transversely pivoted thereto and is inwardly of the sides of said latch plates to prevent access to said release member by a pole or other tool. The release member has camming engagement with the latch and is operable by hand to cam the latch out of engagement with the keeper and accommodate opening of the door.

5 Claims, 14 Drawing Figures

Fig. 5
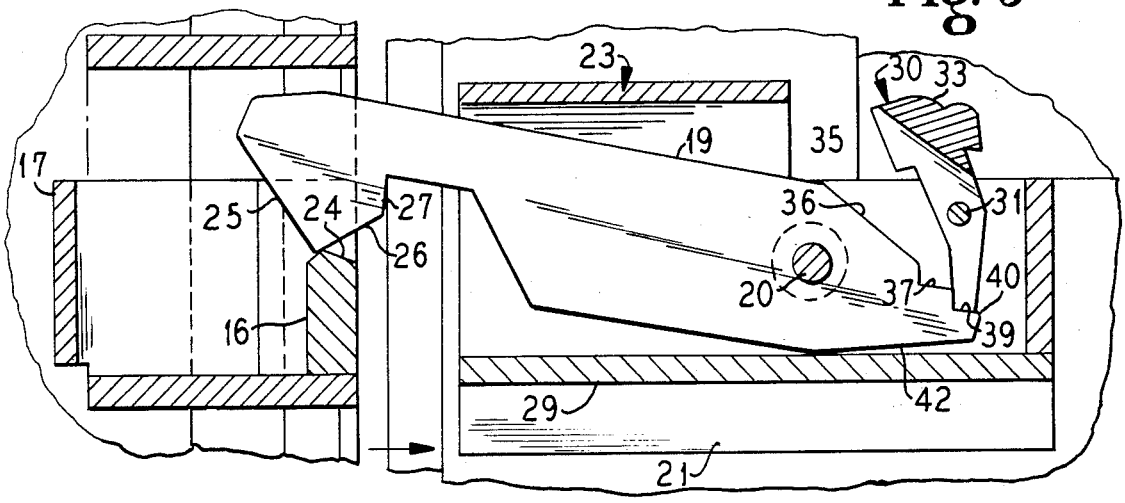
Fig. 6
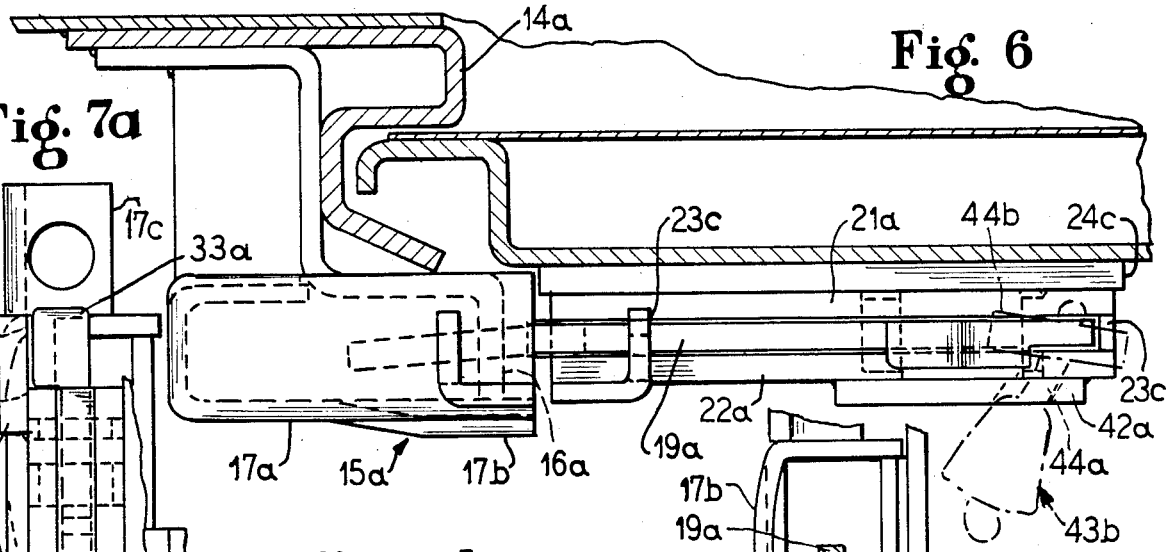
Fig. 7a
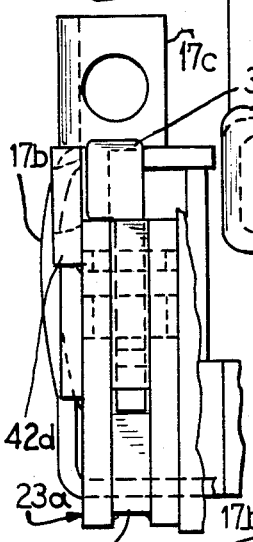
Fig. 7b
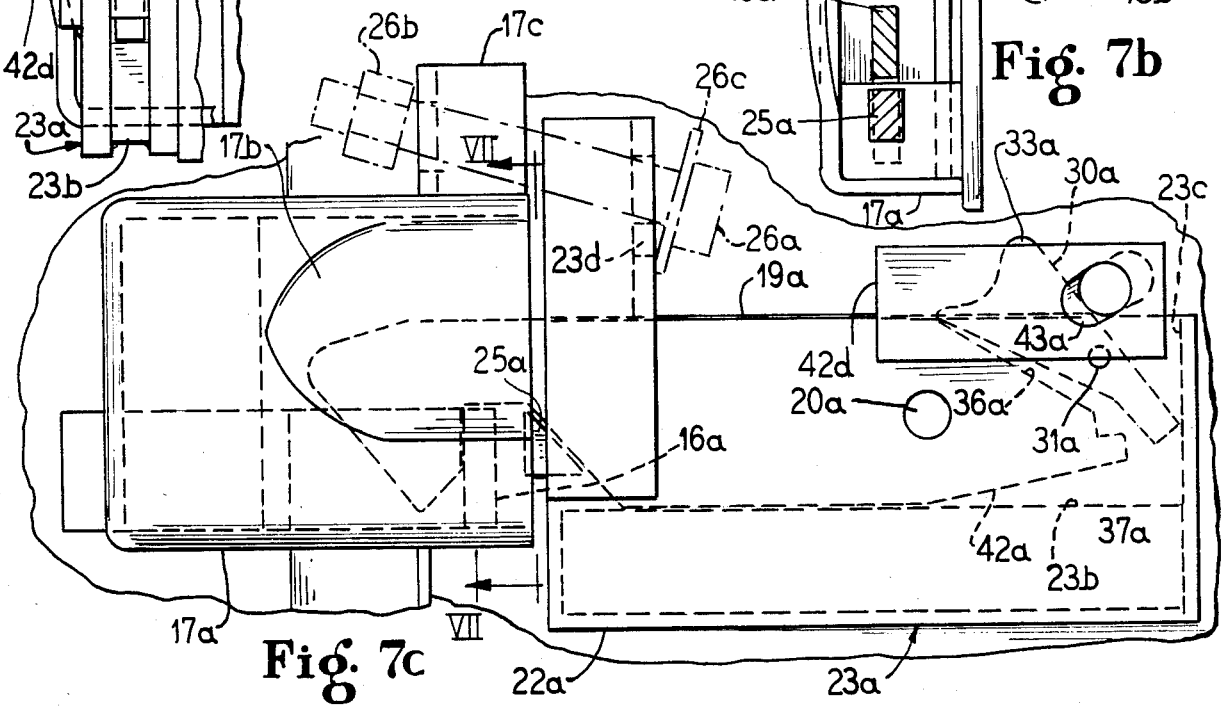
Fig. 7c

PILFERAGE DETERRENT DEVICE FOR LADING CARRYING VEHICLES, SUCH AS BOXCARS AND THE LIKE

This is a continuation, of application Ser. No. 500, 371, filed June 2, 1983, now abandoned, which is a continuation-in-part of my application Ser. No. 298,592 filed Sep. 2, 1981 and now abandoned.

BACKGROUND OF THE INVENTION

The losses by pilferage from railway freight cars such as box cars and including highway trucks and trailers are a large factor in the cost of shipment of lading. These losses particularly occur when the cars are in the yard or on a siding awaiting transfer to an unloading station or to another destination, even though locks and seals are provided for the doors and the seals are not intentionally broken except when the car is standing along an unloading dock. The locks and seals are readily accessible from the ground both with sliding doors and plug types of doors, both of which doors are in common use at the present day. Even though the locks for these doors are sturdy their accessibility from the ground requires little ingenuity and energy to release the locks with the result that the freight yards must be continuously policed and even then the loss due to pilferage is substantial.

SUMMARY ADVANTAGES AND OBJECTS OF THE INVENTION

The pilferage deterrent device supplements the conventional door locks and is positioned so that it cannot be set for release from the ground even with a pole or other instrument and then can only be released by a man standing on a loading dock or other elevated position and even then cannot be pried or otherwise moved to a release position except by an authorized person knowing how to release the lock.

The pilferage deterrent device supplements the usual door lock and is toward the top of the door where it is inaccessible except from a loading dock or other elevated platform and is entirely enclosed from the bottom and is only open at the top to accommodate access to a release member for the lock commonly termed a trigger, which cocks the lock to a release position and thereby accommodates release of the lock by opening movement of the door.

An object of the present invention is to provide a simple and improved means for protecting lading carrying vehicles, such as boxcars and the like from pilferage.

A futher object is to provide a simplified form of protective device for lading carrying vehicle doors which cannot be released from the ground while the vehicle is standing in the yard or on a siding and is only accessible for release from an elevated platform such as a loading dock.

An advantage of the invention is that the pilferage deterrent device is adaptable to various types of lading carrying vehicle doors and its moving parts are concealed so the lock cannot be released by a pole and the like and can only be released from the top of the lock by a man on the loading dock knowing the operation of the lock.

Another advantage of the invention is that the device is toward the top of the door of either the sliding or plug type and then is only accessible for release from an elevated loading dock and cannot be released from the bottom of the device or the sides thereof.

Still another advantage is that the device is of a simplified form and is self-acting after a simple cocking or setting operation and has a miniumum number of moving parts and is adapted to both sliding and plug type doors.

Other objects, features and advantages of the invention will be readily apparent from the following description of a preferred embodiment thereof, taken in conjunction with the accompanying drawings, although variations and modifications may be effected without departing from the spirit and scope of the novel concepts of the following disclosure.

DESCRIPTION OF THE DRAWINGS

FIG. 5 is a sectional view taken along the latch and keeper of the pilferage deterrent device and showing the latch cocked in position to pass over the keeper as the door is moving toward its open position.

FIG. 6 is a top plan view of a pilferage deterrent device constructed in accordance with the principles of those shown in FIGS. 1-5, modified to make it adaptable for all types of sliding doors and particularly for sliding doors in which the door may be bent inwardly by lift trucks and the like.

FIG. 7 is a view in side elevation of the pilferage deterrent device shown in FIG. 6.

FIG. *7a* is an end view of the device looking at the device from its rear end.

FIG. *7b* is an end view of the keeper housing with certain parts broken away, with the latch and pilferage deterrent lock secured to the latch housing and shown in transverse section and taken substantially along line VII—VII of FIG. 7.

Figure 8:
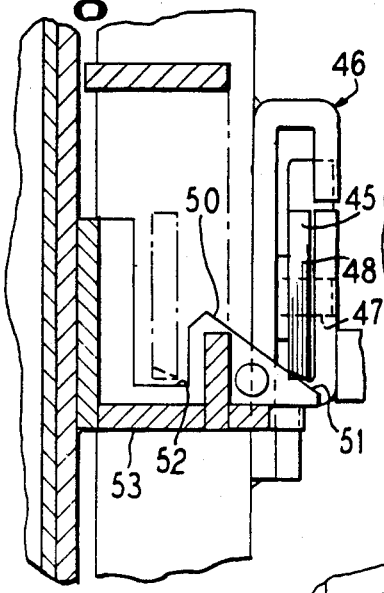

FIG. 8 is a transverse sectional view taken through the keeper housing showing the keeper and latch in broken lines.

Figure 9:
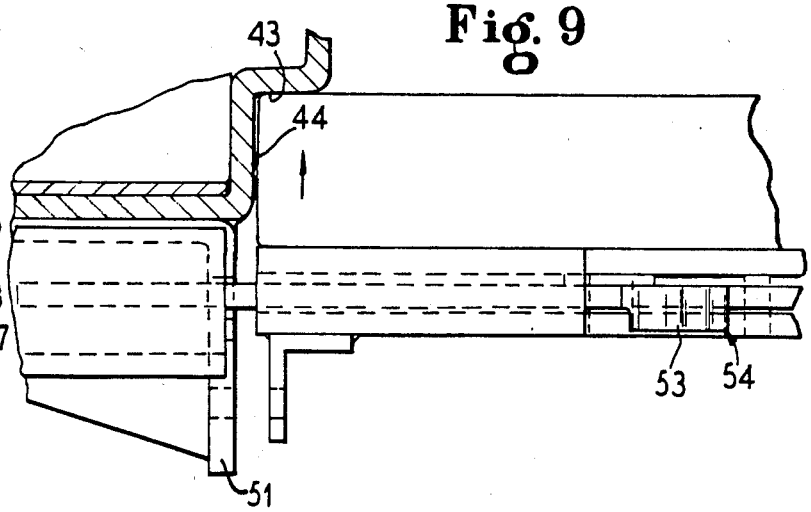

FIG. 9 is a fragmentary sectional view diagrammatically showing the door in its closed position and showing the pilferage deterrent device constructed in accordance with the principles of the present invention in its locked position.

Figure 10:
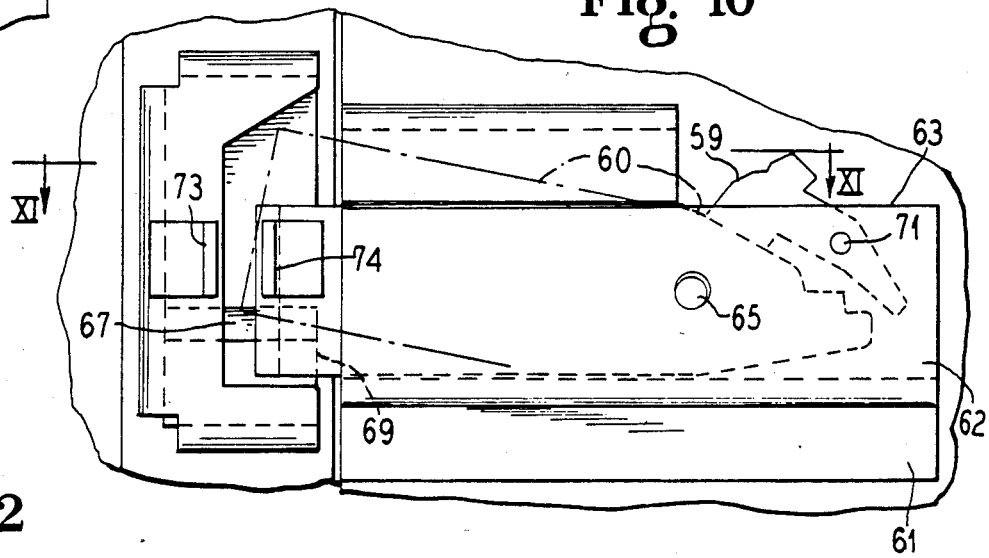

FIG. 10 is a view in side elevation illustrating a modified form of pilferage deterrent device adapted for a plug type door which may be constructed in accordance with the principles of the present invention.

Figure 12:
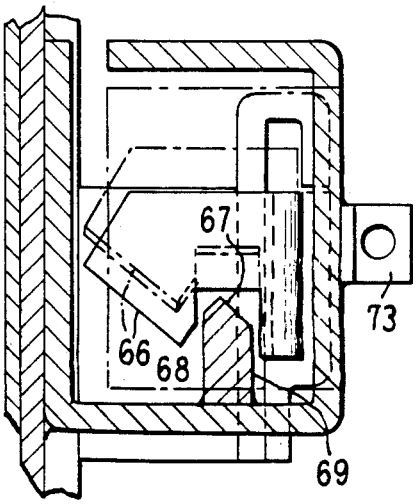
Figure 11:
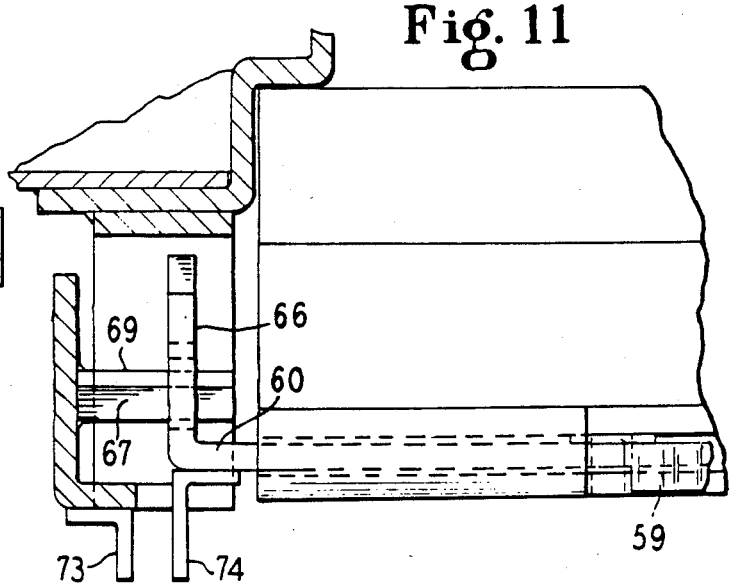

FIG. 11 is a fragmentary sectional view taken substantially along line XI—XI of FIG. 10; and FIG. 12 is a fragmentary sectional view taken substantially along line XII—XII of FIG. 10.

Figure 1:
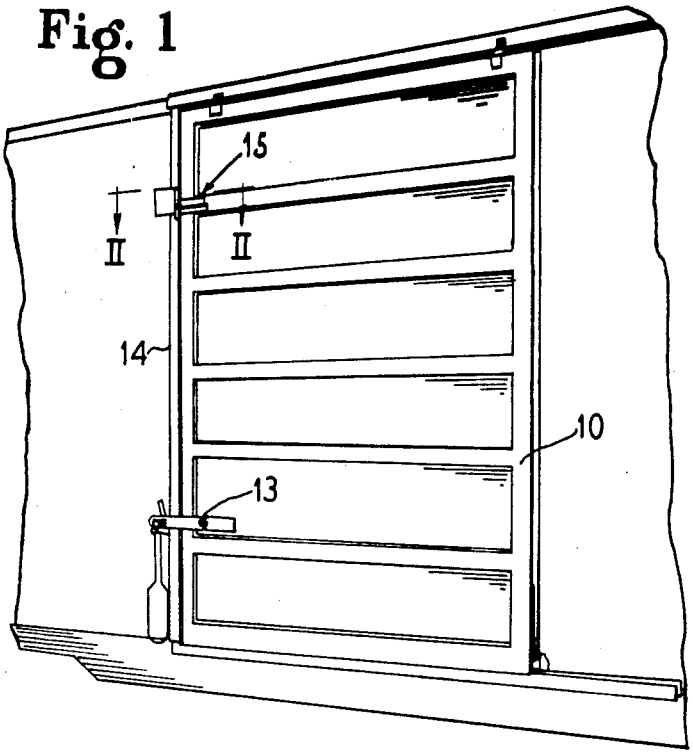
FIG. 1 is a view in side elevation of a fragment of a side wall of a lading carrying vehicle showing a door closing the doorway of the car and diagrammatically showing the pilferage deterrent device constructed in accordance with the principles of the present invention mounted on a lading and carrying vehicle door and shows a door post defining one margin of the doorway.
Figure 4:
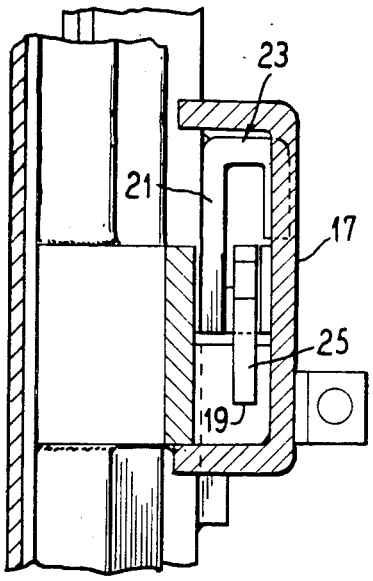
FIG. 4 is a sectional view taken substantially along line IV—IV of FIG. 3.

In the embodiment of the invention illustrated in the drawings, I have shown in FIG. 1 a lading carrying vehicle door 10, which may be a box car door slidably mounted to move along an opening 11 in a wall of the car or other lading carrying vehicle to close said opening. The box car and slidable door are conventional and the door is locked in its closed position by conventional locking means located toward the bottom of the door and generally indicated by reference numeral 13, diagrammatically shown herein, and not described or shown in detail since freight car and other lading carrying vehicle door locks may be of various conventional forms. I have also shown a door post 14 and an pilferage deterrent device 15 constructed in accordance with the principles of the present invention mounted on the door and door post in a position that cannot readily be reached from the ground and can only by reached when the car is along a loading dock or other elevated platform for loading or unloading.

Figure 2:
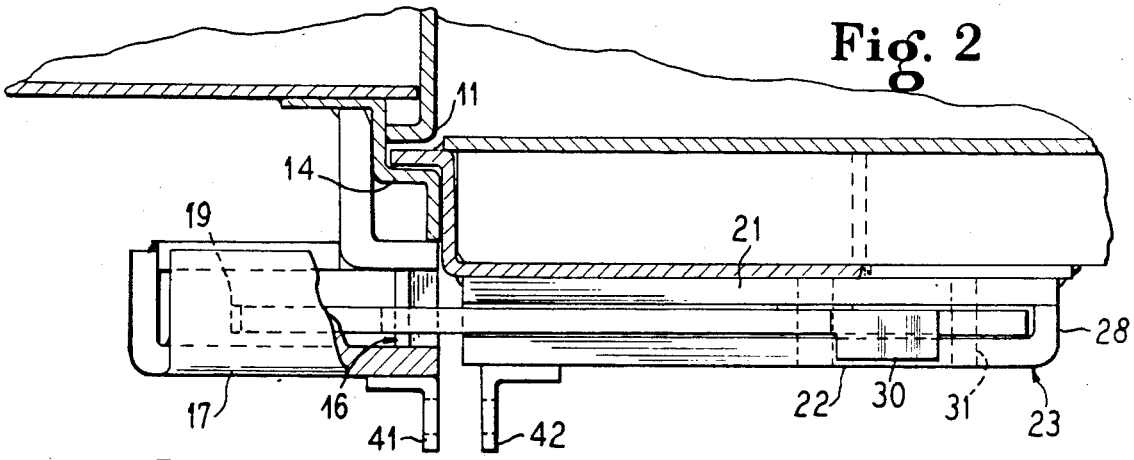
FIG. 2 is fragmentary sectional view taken substantially along line II—II of FIG. 1.

In FIG. 2, I have shown a horizontal sectional view taken through the pilferage deterrent device and have shown the pilferage deterrent device as including a keeper 16 mounted on the door post and enclosed in a housing 17 which may be mounted on the door post, and extend outwardly therefrom along the car in a direction away from the door opening. The keeper is shown in dotted in FIGS. 3 and 5 as enclosed in the housing 17 extending along and outwardly of the door post a distance sufficient to accommodate a latch 19 to move into a closed position upon sliding movement of the door to its closed position and engage the keeper to lock the door in its closed position in addition to the lock 13 for the bottom of the door.

The keeper is protected from access by pilferers by the housing 17. Said housing extends along the bottom of the keeper and forms a mounting thereof as shown on FIGS. 3 and 5 and also extends upwardly along the keeper and along the end and across the top of latch 19, to prevent access to the latch by the fingers or by a bar or other tool, and accommodates free movement of the latch to the closed position shown in FIGS. 2 and 3, 4 and 5.

The latch 19 is transversely pivoted eccentric of its longitudinal center and toward the rear end of the latch on a transverse pivot pin 20 mounted at its opposite ends in inner and outer parallel plates 21 and 22 respectively of a latch housing 23. The inner of said plates is welded or otherwise secured to the outer surface of the door 10, diagrammatically shown in FIG. 1 as being a conventional sliding type of door. The latch project beyond the end of the door toward the door post 14 and as the door is moved to its closed position is cammed to drop into the latched position, shown in FIG. 3.

Seal tabs 41 and 42 project outwardly of the adjacent ends of the housings 17 and 23, respectively and are apertured to receive the conventional freight door seals (not shown).

The latch 19 extends a substantial distance from the pivot pin 20 into the housing 17 for the keeper 16 and has an advance inclined strike surface 25 inclined downwardly from the advance end thereof and terminating at its lower end into an upwardly inclined surface 26, leading to a vertical latching surface 27 adapted to have latching engagement with the keeper 16 as the door 10 is closed.

Figure 3:
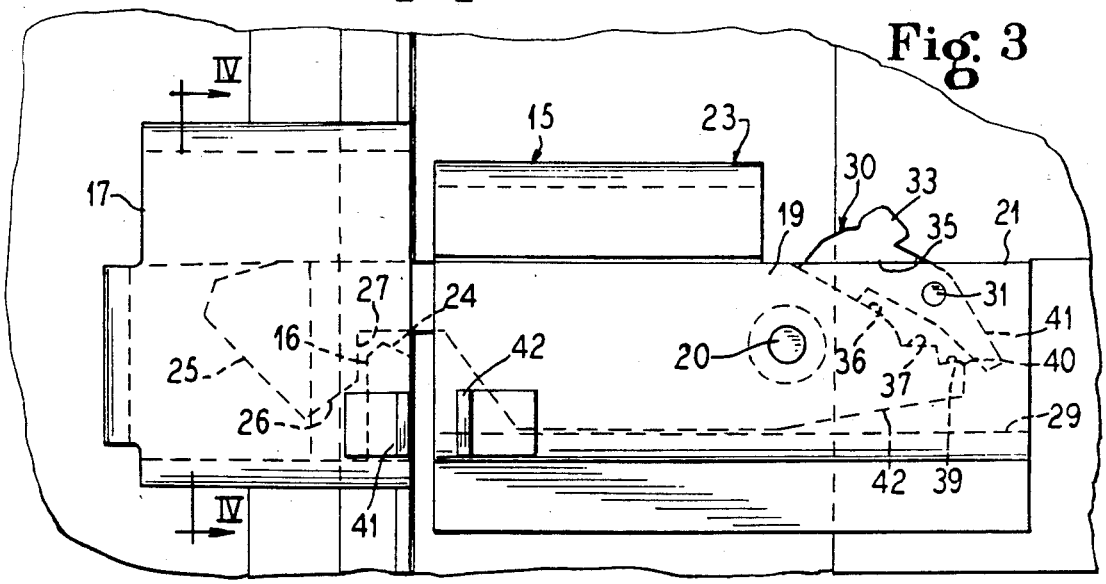
FIG. 3 is a side elevational view of the pilferage deterrent device shown in FIG. 2.

The keeper 16 extends outwardly of the door post 14 within the housing 17 and is shown as having a peaked top 24 engageable with the strike surface 25 of the latch 19 during closing movement of the door to raise the latch and accommodate the latch to drop into the latched position shown in FIG. 3.

The housing 23 for the latch includes the inner plate 21 welded or otherwise secured to the door. Said inner plate 21 is shown as bent outwardly to extend over the latch when in its latched and unlatched positions and then downwardly along the latch to the plate 22 in alignment therewith. The downwardly extending portion stops short of the end of the plate 22 but the plate 21 extends to the end of said plate 22 to enable the pivot 21 to be mounted at its ends, with the latch 19 therebetween.

The housing 23 also has a portion 29 extending across the bottom of the latch to close the bottom of the housing and prevent tampering of the latch from beneath. The bottom portion 29 of the housing extends to the plate 21 to which it is welded or otherwise secured, to completely house the latch except for an open portion between said plates 21 and 22 at the rear end portion of the plate 22, to accommodate a release member 30 to project above the plate 22. An end portion 28 of the plate 22 extends inwardly to the plate 21 to which it may be welded or otherwise secured.

The release member 30 is commonly termed a trigger and pivoted between the plates 21 and 22 on a pivot pin 31 spaced rearwardly of the pivot pin 20 and above said pivot pin. A counterweight 33 is on the upper end of the release member 30 and extends above the plates 21 and 22 to afford access to the release member 30 accept by the thumb or other finger of the hand.

The counterweight 33 at the upper end of the release member 30 is within the outer margin of the plate 22 (FIG. 2) and has a plain face 35 engageable with the top of the plate 22 when the latch is in its latched position, and forming a stop for said release member, in a direction shown in FIG. 3 as being a counterclockwise direction.

The counterweight 33 also extends to an inclined surface 36 of the latch 19, inclined downwardly from the top of said latch toward the rear end thereof. The inclined surface 36 terminates into a step 37, which in turn terminates into a lower step 39 having a rounded camming surface 40 at its rear end.

It should be further understood that the rear end portion of the latch has a bottom surface 42 inclined in an upward direction from a position in alignment with the pivot pin 20 to provide clearance between the latch and the inwardly projecting portion 29 of the plate 22, to prevent dirt which may lodge between the plates 21 and 22 from interfering with opening and closing movement of the latch.

The latch and keeper are, therefore, fully protected and release can only be attained by engaging the counterweighted portion 33 of the release member 30 by the thumb or other finger and moving said release member in a direction, which in FIG. 3 may be a clockwise direction.

It should further be noted from FIG. 5 that when the door is moved in the direction of the arrow, the trailing inclined portion 26 of the strike 25 will move upwardly along the trailing portion of the peak 24 of the keeper a period the release 30 engaging the step 39 will hold the latch in the position shown until movement of the door in a direction to disengage the latch 19 from the keeper. The counterweight 33 will then move the release member 30 out of engagement with the step 39, to release the latch and the release member 30 and counterweight 33 are so located as to be inaccessible from the ground or from the bottom of the latch and can only be moved to cam the latch to its released position by a person on a loading platform and then reaching upwardly a substantial distance to effect intentional release of the latch.

It should further be understood that the latch 19 is freely pivoted on the pin 20 and the release member is freely pivoted on the pin 31 to assure that the latch may be released by pushing the release member 30 to the right and moving the lever arm 40 of said release member to engage the step 39 and hold the latch in its released position to accommodate opening of the door. It should further be understood that after the door is opened, if the release member 30 should come out of released engagement with the latch, the latch may be closed upon camming of the latch by the strike 25 of the latch and peaked surface 24 of the keeper to its closed position.

In FIGS. 6, 7, 7*a* and 7*b*, I have shown a modified form of pilferage deterrent device universally adapted to sliding doors of various forms and particularly applicable to steel doors which may be bent by lift trucks and the like, and which is operate when the doors may be bent sufficiently to position the srtike surface of the ledge outwardly of the door opening at an angle.

In this form of the invention, I have shown a door post 14*a* a pilferage deterrent device 15*a* mounted on the door and door post at an elevation that makes the device difficult to reach from the ground.

The pilferage deterrent device cooperates with a keeper 16*a*, mounted on the door post and enclosed in a housing 17*a*, which is mounted on the door post, and extends outwardly therefrom and in a direction away from the door opening.

The keeper 16*a* is shown in dotted in FIGS. 6, 7, and 7*b* as extending vertically along the door opening in a plane close to the plane of the end of the door post.

A latch 19*a*, cooperating with the keeper 16*a* is pivotly mounted in a latch housing 23*a* between two parallel spaced plates 21*a* and 22*a* of the latch housing 23*a* on a pivot pin 20*a*.

The plates 21*a* and 22*a* of the latch housing are spaced apart adjacent their lower ends by a spacer plate 23*b* extending along said plates adjacent the lower ends thereof and welded or otherwise secured to said plates. A closure plate 23*c* extends across the plates 21*a* and 22*a* and abuts the rear end of the spacer plate 23*b* and encloses the space between the plates 21*a* and 22*a*. The foregoing construction is clearly shown in FIGS. 6 and 7.

The plate 22*a* is spaced outwardly of the car door to extend in parallel relation to respect thereto by a spacer 24*c*, which may be welded or otherwise secured to the plate 22*a* and to the car door.

The latch 19*a* extends beyond the latch housing 23*a* within the housing 17*a* for the keeper and into engagement with the keeper 16*a* when the door is closed, as shown in FIG. 7 and in the same manner the latch 19 engages the keeper 16.

FIG. 6 illustrates the top portion of the latch 19*a* engaging the keeper 16*a* and shows that this portion of the latch is slightly bent outwardly toward the outer vertical wall of the latch housing. The outwardly bent surface of the latch including its strike surface and latching surface may be at an angle in the order of 5 degrees to compensate for conditions where the freight car door may be bent by a lift truck improperly used, to position the latch where it might jam against the keeper.

In extreme conditions the bent end portion of the latch may engage an outward recessed portion 17*b* in the outer wall of the latch housing which would serve to cam the latch inwardly of the wall of the housing to engage the keeper as shown in FIG. 6. This bent angle of the strike surface and latching surface of the latch 19*a* would also serve to enable the latch to engage its keeper in cases where the end of the door may be bent inwardly.

In FIG. 7 I have shown a spacer 25*a* extending between the plates 21*a* and 22*a* of the housing 23*a* and spaced close to the latch when the latch is in its locked position. The spacer 25*a* is not only to space the plates 21*a* and 22*a* apart at their ends adjacent the door post but also to prevent release of the latch by a thin piece of metal or even a credit card which may be placed in the space between the end of the latch housing and the adjacent end of the keeper housing and engage the latch to move the latch to a released position.

The outer plate 22*a* of the latch housing 23*a* has a bracket extending upwardly therefrom and having an internal right angled upper end portion 23*c* having an opening therein, such as a drilled hole to receive a conventional seal or a bolt 26*a*. The bolt 26*a* is shown as extending angularly upwardly from sealing bracket 23*c* through a hole in a right angled portion of the sealing bracket 17*c* to receive the bolt 26*a* or a conventional seal. As shown in FIG. 7 a nut 26*b* is threaded on the bolt 26*a* to engage the bracket 17*c* and also to engage the washer 26*c* with the head of the bolt and with the sealing bracket 23*d*.

A release member or trigger 30*a* is provided to release the latch from above the housing 23*a*. The release member 30*a* is pivoted between the plates 21 *a* and 22*a* on a pivot pin 31*a* spaced rearwardly of the pivot pin 20 and above said pivot pin. A counterweight 33*a* similar to the counterweight 33 shown in FIG. 3 of the drawings, is formed as part of the upper end of the trigger 30*a* and extends above the plates 21*a* and 22*a* to afford access to the release member or trigger 30 by the thumb or other finger of the hand.

The counterweight 33 at the upper end of the release member 30*a* is within the space between the plates 21*a* and 22*a* and extends outwardly along the top of the plate 22*a* into engagement with said plate when the latch 19*a* is in the latched position shown in FIG. 7.

The counterweight 33*a* extends to an inclined surface 36*a* of the latch 19*a*, which is inclined downwardly from the top of said latch toward the rear end thereof. The inclined surface, 36*a* terminates into a step 37*a* rounded at the outer end of its run to be engaged by the lower end of the trigger 30*a*.

In order to accommodate release of the latch by the trigger 30*a*, the lower rear end portion of the latch 19*a* has an inclined bottom surface 42*a*, inclined in an upward direction from a position in alignment with the pivot pin 20*a* to provide clearance between the latch and the spacer 23*b* spacing the plates 21*a* and 22*a* apart to form a housing for the latch. This provides clearance between the downwardly projecting portion of the trigger 30*a* and the latch 19*a* and accommodates the latch 19*a* to move about the pivot 20*a* to a release position as pressure is exerted on the counterweight 33*a* to move the trigger about the pivot 20*a* and cam the latch to a in position to be released from the keeper upon door opening movement. The trigger 30*a* operates like the trigger or release member 30 shown in FIGS. 3 and 5, as previously described, so a detailed description thereof need not be repeated herein.

A plate 42*d* is welded or otherwise secured to the outer side of the plate 22*a* and extends upwardly therefrom along the trigger 30*a* close to the top of the counterweight 33*a* of said trigger. The plate 42*d* serves as a guard for the trigger 30*a* and makes it impossible to move said trigger to a release position except by an authorized person releasing the latch by movement of the trigger in a direction which in FIG. 7 would be in a clockwise direction attained from above the guard plate 42*d*. The guard plate 42*d* has an elongated open portion or slot 43*a* therein, to receive a bolt or seal 43*b*. FIG. 6 shows the seal 43*b* as being a conventional bell type of slip on seal, in which a flexible cable 44*a* extends throughout the slot 43*a* and has a head 44*b* on the inner end thereof extending in the space between the plates 21*a* and 22*a*. A locking bell is slipped on the outer end of the cable and moved inwardly along the cable into the slot 43*a* to form the seal and positively prevent movement of the trigger 30*a* into a release position.

The principle of operation of the latch illustrated in FIGS. 6, 7*a*, 7*b* and 7*c* is similar to that illustrated in FIGS. 2 through 5 so need not herein be described further.

Referring now in particular to FIGS. 8 and 9 and the application of my pilferage deterrent device to plug type freight car doors of the center crank type in which the door is supported for movement toward the door post and when in alignment with the door opening is cranked inwardly along the door opening to a position substantially flush with the side of the car and into engagement with an outer wall 43 of the post facing outwardly and terminating at its inner end into an end wall 44 facing the door opening. This construction is shown in FIG. 8 and it should be understood that each end of the door is recessed in the post in a conventional manner, as the door is cranked inwardly into its closed position, after it has been moved into alignment with the door opening.

In FIG. 8, a latch 45 is shown as pivoted between the parallel slide plates of a housing 46, like the housing 23, on a pivot pin 47 mounted at its ends in said plates as in the form of the invention illustrated in FIGS. 1 through 5. Since the housing 46 is like the housing 23 it need not herein be shown or described further.

The latch 45 has a tapered nose 48 (not shown) converging to a rounded end and is moved into the latched position shown in FIG. 9, as the door is moved inwardly and the underside of said nose moves along an inclined advance side 51 of the keeper 50, as shown in FIG. 8. As the latch moves to the peak of the keeper during movement of the door in the direction of the arrow to a closed position as shown in FIG. 9, the latch will drop along the inside of the keeper into a recess 52 of said keeper and lock the door from opening. It may be seen from FIG. 8 that the keeper recess 52 and the portion above the latch as it is in its locked position are all enclosed in a housing 53 to prevent the release of the latch from the keeper by hand.

A release member 54 like the release member 30 is pivoted between the side plates of the housing 46 on a pivot pin 55, mounted at its ends in the parallel side plates of said housing 46. The release member 54 is like the release member 30 shown in FIG. 5 and operates on the same principles so need not be described except to point out that said release member is moved to the right to cam the latch into the release position shown by broken lines in FIG. 7.

In FIGS. 10, 11 and 12, I have shown a modified form in which my invention may be embodied. In the embodiment shown in these figures, the latch lever and keeper are enclosed in separate housings for a greater portion of length of said members and are inaccessible except by engagement from the top of the housing for the latch lever by engaging the exposed portion of the counterweighted portion of a release member 59. In this form of the invention, as illustrated in FIGS. 10, 11 and 12, a latch lever 60 is eccentrically pivoted between plates 61 and 62 of a housing 63 on a transverse pivot pin 65 disposed adjacent the rear end of said latch lever. The latch lever has a right angled strike surface 66 engaging an inclined surface 67 of a peaked keeper 69 extending in a direction parallel to the door post and door opening.

As the door is moved to a closed position, the strike surface 66 of the latch will come into engagement with the inclined surface 67 of the keeper. This will cam the latch over the keeper to drop into the position shown by solid lines in FIG. 12 with a recessed portion of the latch on opposite sides of the keeper.

The release member 59 is pivoted between the side plates of the housing 63 on a pivot pin 71, like the release members 30 and 54, to release the latch from above the latch housing 63 as in the forms of anti-pilferage devices illustrated in FIGS. 1 through 9.

It may be seen from the foregoing that the anti-pilferage device of the present invention may readily be adapted to various types of box car and trailer doors and is enclosed to prevent opening of the latch by hand except by operation of the release member therefore, which is at such an elevation and is spaced inwardly of its housing 50 that it cannot ordinarily be reached by hand or by a bar or pole or other tool.

While the latch and keeper structure may be of various forms, it should be understood that an important part of the invention in addition to placing the anti-pilferage device at an elevation inaccessible to pilferers and enclosed so even poles or tools cannot release the release member due to the enclosing of all parts of the latch and keeper, that the anti-pilferage device can thus only be operated to position the latch to be released upon door opening movement from above at an elevation that can only be reached from a loading dock or other elevated position.

In the present disclosure the anti-pilferage device is located at least seven feet above the floor or bottom of the box car door and cooperates with the conventional locks disposed adjacent the bottom of the door. It prevents opening of the door even though the bottom latches are in release positions.

Tabs 73 and 74 having registering apertured portions for a conventional seal, are shown in FIGS. 10 and 11 as extending outwardly of the outer side of the latch and keeper housings.

I claim as my invention:

1. A pilferage deterrent device for lading carrying vehicle door assemblies and the like, supplementing the conventional door lock accessible from the ground, comprising two elements, one of which is movable relative to the other, a keeper on one of said elements, a pivoted latch on the other of said elements, and engageable with said keeper to retain the door closed, a housing for said pilferage deterrent device including two spaced plates, one being mounted on the door assembly and extending along the latch for a portion of the length thereof and along the top of said latch, and a second plate spaced laterally of the one plate, closure means closing the bottom portion of said latch housing, the two plates being so constructed as to prevent access to said latch, said latch having an advance strike surface engageable with said keeper to pivotally move said latch in an upward direction upon movement of one element toward the other and having a latch surface engageable with said keeper to hold said elements from movement relative to each other, a release member manually operable to engage and move said latch to a position to accommodate release of the latch and to hold the latch in a release position until door opening movement and accessible only from the top of the said plates, a pivot for said latch mounted on said plates and extending therebetween and spaced along said plates a substantial distance from said strike surface to accommodate said latch to close by gravity as cammed upwardly by engagement with said keeper, a pivot for said release member mounted on said plates and located above and rearwardly of the pivot for said latch, said release member having a counterweight extending along its upper end portion and extending above said plates and biasing said release member out of releasing engagement with said latch and engageable by the hand to cam the latch into position to move over the top of said keeper upon manual pressure thereon, and said release member having a lower end having camming engagement with said latch to effect movement of said latch upwardly along said keeper in position to move over the top of said keeper as said release member is pivotally moved by hand, and hold said latch in such a position until movement of said door in an opening direction, guard portions in the form of a housing opening to said latch, and a spacer extending into said housing to prevent release of said latch from the space between said housing and plates.

2. The pilferage deterrent device of claim 1 in which the spacer is triangular in form and generally conforms to the under surface of said latch and extends between both of said plates to space said plates apart adjacent the door post.

3. The pilferage deterrent device of claim 1 in which the end of said latch extending into said keeper housing is bent outwardly at a slight angle to compensate for deformation of the door caused by rough handling by lift trucks and like loading apparatus.

4. The pilferage deterrent device of claim 3 in which the housing has an outer wall having a recess therein of a generally bulbous form, the interior of which serves as a cam said latch to engage said keeper upon extreme conditions of deformation of the door.

5. In combination with a lading carrying vehicle having a floor, side walls extending upwardly therefrom, end walls connecting said side walls together and a door opening in at least one of said walls, a door operable to open and close said door opening, primary locking means for said door, disposed adjacent the bottom of said door and manually operable to lock the door closed, the improvement comprising; secondary locking means disposed above the primary locking means and operable by door closing movement independently of said primary locking means and comprising a keeper, a latch freely pivoted on said door in position to engage said keeper upon closing movement of the door, said latch extending parallel to the outer surface of the door and pivoted thereto eccentric of its center, to bias said latch into locking engagement with said keeper by gravity upon door closing movement, the end of said latch engageable with said keeper having an inclined strike surface camming said latch into position to have locking engagement with said keeper upon door closing movement and having a vertical latching surface along which the latch drops by gravity, a release member having a counter weight thereon, pivot means mounting said release member for movement about an axis parallel to the axis to pivotal movement of said latch, disposed rearwardly of and above the axis of pivotal movement of said latch, housing means enclosing said secondary latch and the lower portion of said release member and forming mountings for the pivots for said secondary latch and said release member wherein said release member is the sole means of camming said latch to an unlatching position and being accesssible only from a top portion of said housing means, and said latch having a rear upwardly facing face converging toward its lower end, and terminating into a step, and said release member having an undersurface extending along the converging surface of said latch when the latch is locked, to accommodate a reduced end of said release member to engage the step on said latch and hold said latch in said unlatching position, and means to automatically release said latch from said unlatching position including an angled surface carried on said latch and arranged to contact said keeper to cam said latch upward over said keeper upon movement of said door toward on open position and to concurrently disengage the step on said latch from said reduced end of said release member, whereupon said counter weight is effective to swing said release member free of said latch, whereby the latch will be repositioned by gravity to engage said keeper upon subsequent closing movement of the door.

* * * * *